US006102460A

United States Patent [19]

Baldo Ramos et al.

[11] Patent Number: 6,102,460

[45] Date of Patent: Aug. 15, 2000

[54] DEVICE FOR SUPPORTING TAMPING BENCH ARMS

[75] Inventors: Luiz Paulo Baldo Ramos; Cosme Damiao Bunicena Fermino; Carlos Magno Santos Pinila; Roger Cordeiro Bernardino, all of Espirito Santo, Brazil

[73] Assignee: Companhia Vale Do Rio Doce, Minas Gerais, Brazil

[21] Appl. No.: 09/252,705

[22] Filed: Feb. 18, 1999

[30] Foreign Application Priority Data

Mar. 11, 1998 [BR] Brazil ..... 7802187 U

[51] Int. Cl.[7] ..... B66C 1/22

[52] U.S. Cl. ..... 294/67.1; 294/90

[58] Field of Search ..... 294/1.1, 67.1, 294/67.2, 67.21, 67.22, 67.3, 67.4, 67.5, 90, 91, 92; 29/281.1, 283

[56] References Cited

U.S. PATENT DOCUMENTS

| | | | |
|---|---|---|---|
| 580,737 | 4/1897 | Smith | 294/92 |
| 1,560,411 | 11/1925 | Conklin | 294/92 |
| 2,569,978 | 10/1951 | Dunlap | 294/92 |
| 2,674,485 | 4/1954 | Jamison | 294/92 X |
| 3,797,877 | 3/1974 | Soehrens | 294/67.1 |
| 4,471,986 | 9/1984 | Goodhall | 294/67.1 X |
| 5,419,601 | 5/1995 | Mikkola | 294/67.1 |

*Primary Examiner*—Johnny D. Cherry
*Attorney, Agent, or Firm*—Helfgott & Karas, P.C.

[57] ABSTRACT

A device for supporting tamping bench arms and for engagement with a horizontal rib provided on the arm is formed from a pair of parallel rectangular spaced apart side walls (1) interconnected by a back wall (2) and a pair of horizontal plates (4) attached to the upper and lower edges of the back wall (2) and extending from the central surface portion of the back wall approximately half the length of the side walls (1). While the device is suspended from above, the rectangular plates are slid into engagement with the horizontal rib provided on the tamping bench arms, enabling an operator to effortlessly move and manipulate the tamping bench arms.

2 Claims, 3 Drawing Sheets

DEVICE FOR SUPPORTING TAMPING BENCH ARMS

The present specification relates to a device for supporting tamping bench arms, and more specifically a support to help assembling and disassembling the arms of the tamping bench which are usually suspended by a winch a crane.

As is well known of those skilled in the art, a line tamper is an equipment for aligning and leveling the line as well as tamping the ballast or crushed rock used in railroads. One of the main components of said tamping equipment is the tamping bench made out of tamping tools or arms that are coupled to the tamping equipment.

It is known that for the general assembling of the tamping bench a pin is inserted under pressure between the arm and the bench frame in such a way that said pin starts acting as the axle of the arm which tends to perform a pendulum movement with respect to the tamping bench as soon as it is actuated by the bench packing cylinders.

Conventionally, while the arms are being assembled to the tamping bench, the operator usually needs to hang on the upper end of the arm by pulling same towards himself and at the same time stepping one of his feet against the lower end thereof and moving same away from himself, whereby the arm is simultaneously suspended by a winch or crane. With all those operating steps plus the effort of the operator, the arm is placed at the suitable position to fit into the frame of the tamping bench.

Despite being widely used, said conventional equipment has drawbacks with respect to the difficulty in handling the bench arm during the operations for assembling and disassembling the tamping bench. For the conventionally known operation for assembling and disassembling the bench arm, it is required to use a winch, as well as three workers who are subjected to excessive physical wear the result of which are problems in their spine and limbs.

Another drawback found in the conventional system for coupling the bench arms is th e fact that the operators are put in risk of being harmed when assembling and disassembling said arms in view of the low safety level between the workers and the equipment.

Another drawback found in this system for coupling the bench arms resides in the fact that its suspended condition is necessarily maintained through a winch which limits the installation of the equipment to predefined sites.

An object of the present invention is to provide a device for supporting tamping bench arms which does not expose the workers to physical wear when they assemble or disassemble the bench arms, thus not leading to problems in their spine and limbs.

Another object of the present invention is to provide a device for supporting tamping bench arms which does not require that the bench arms be necessarily suspended and/or supported by a winch when said bench arms are assemble d and disassembled, it being possible to use any other suitable means, thus diversifying the possible sites for installing the equipment.

Another object of the present invention is to provide a device for supporting tamping bench arms which does not require a significant level of manpower and is cost effective in maintaining the equipment when assembling and disassembling said bench arms.

Another object of the present invention is to provide a device for supporting tamping bench arms which makes it easier to assemble and disassemble the bench arms with relation to the equipment.

These and other objects and advantages of the present invention are attained by a device for supporting tamping bench arms comprised of a structural frame consisting of steel plates welded to one another defining parallel rectangular spaced apart side walls, a rectangular back wall interconnecting said side walls which incorporate, into the front end of their upper edge, a corresponding eyelet for coupling with the suspension hook, wherein horizontal rectangular plates are welded to the mean portion of the upper and lower edges of said back wall, said plates extending up to approximately half the length of side walls which constitute the support.

The above mentioned steel support, when coupled to the bench arm to be suspended by the suspension winch, reaches the ideal inclination from its gravity center either for assembling or disassembling the bench arm.

Better conditions for the assembling and disassembling tasks can be attained by this embodiment and it is also possible to install the equipment as a whole in any kind of railway workshop that uses line tamper in the maintenance.

The improved device for supporting bench tamping arms provides for a higher quality product; a higher work safety standard; more productivity through the optimization of equipment, reduction of indirect works and elimination of unnecessary operations; besides allowing for a cost reduction related to the investment made, energy consumption, raw material and/or inputs; and additionally assures a reduction in the loss of material (equipment, etc.).

The improved support can be configured in extended or reduced dimensions since its equilibrium point is not changed, thus continuing to satisfy the work needs.

Now the present improvement will be described with reference to the accompanying drawings, wherein.

Figure 1:
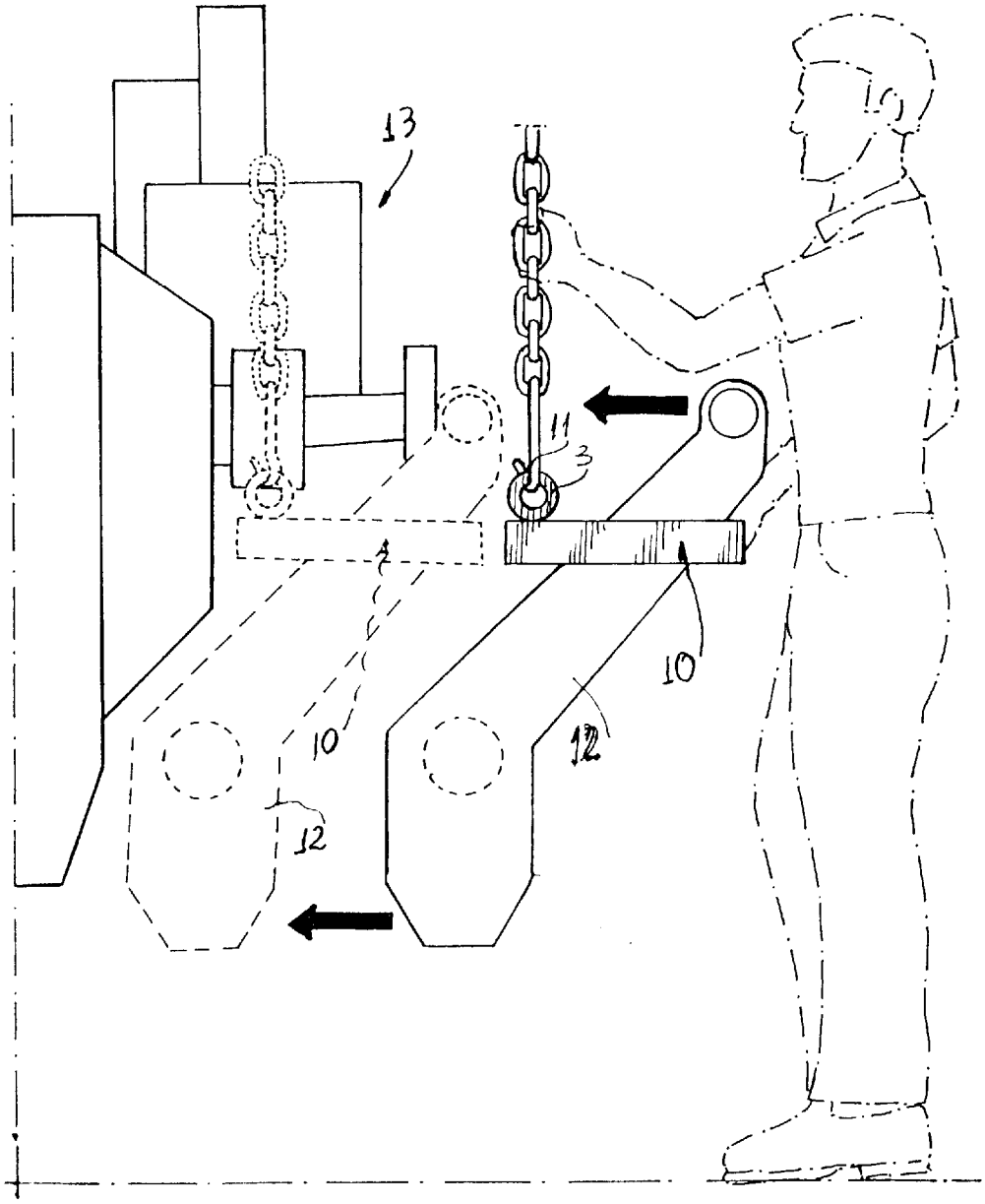
FIG. 1 is an schematic side view of a line tamping equipment provided with a device for supporting the tamping bench arms.
Figure 2:
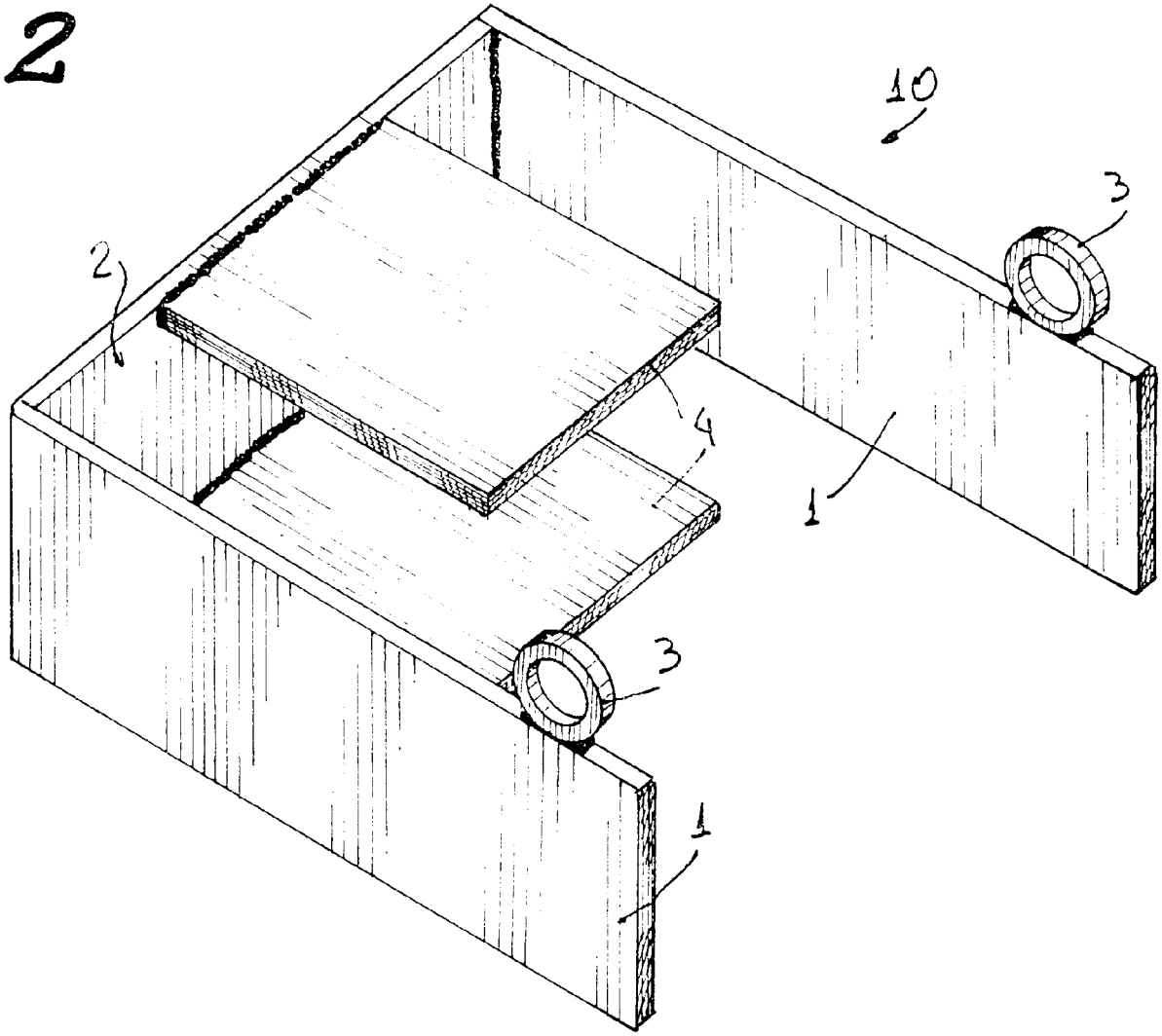
FIG. 2 is a perspective view of the device for supporting the tamping bench arms.

According to these illustrations, the inventive device for supporting the tamping bench arms is comprised of a structural frame 10 consisting of steel plates welded to one another defining parallel rectangular spaced apart side walls 1, a rectangular back wall 2 interconnecting side walls 1 which incorporate, into the front end of its upper edge, a corresponding eyelet 3 for coupling with the suspension hook 11 of a winch or any other suspension means.

Horizontal rectangular plates 4 are welded to a winch portion of the upper and lower edges of back wall 2, said plates extending up to approximately half the length of side walls 1 which constitute the support 10.

As can be seen in FIG. 1, the arms 12 of the tamping bench 13 are fitted between the rectangular plates 4 and the side walls 1 in the supporting device 10 in such a way that a transverse steel plate 12*a* interconnecting the arms 12 (see FIG. 3) is snugly coupled between the rectangular plates 4 (see FIG. 4) thus assuring the assembling and disassembling operation in a fast, simple and effortless way.

Figure 3:
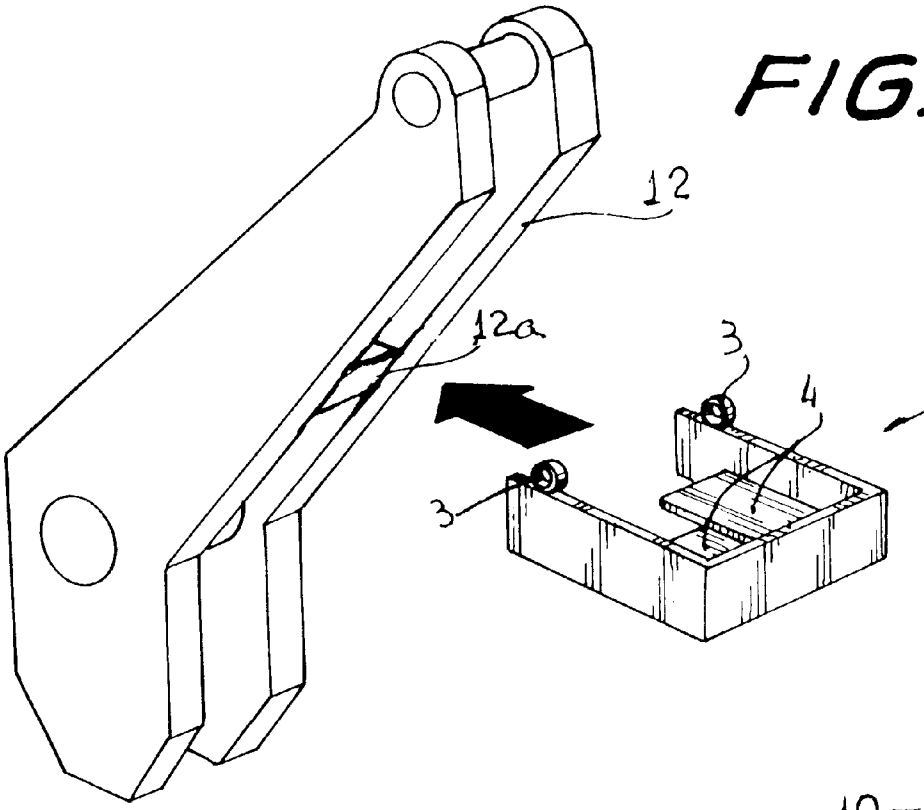
FIG. 3 is a perspective view of the tamping bench arm and the respective support device just before it is coupled and suspended.
Figure 4:
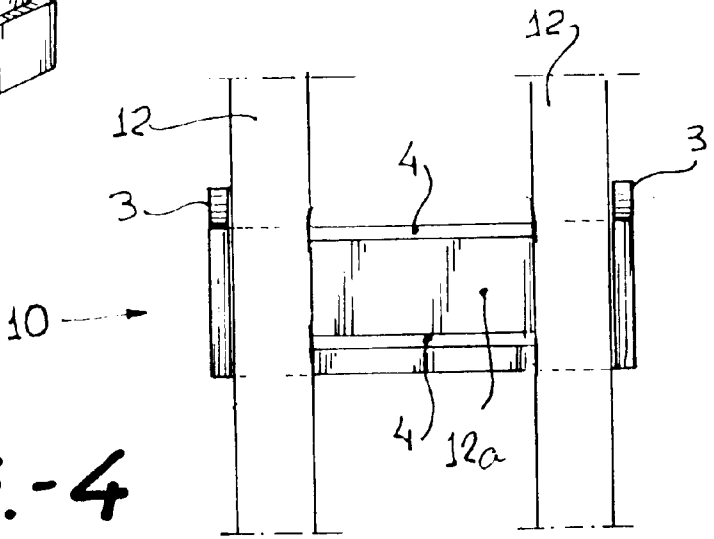
FIG. 4 is a partial front view of the tamping arm assembly coupled to the relevant supporting device.

The transversal "U" shaped supporting device 10 which is intermediately provided with the horizontal square plates 4 constitutes a finger that is hung by the suspension hooks 11 which are inserted into the "O" ring 3 of the supporting device 10 in such a way that the latter is displaced perpendicularly to the assembling operator (see FIG. 1) moving away therefrom, wherein the interrelationship between the support 10 and the arms 12 is effected by fitting of the ribs 12*a* provided on the sides of the arms 12 along the sides edges of the horizontal square plates 4 in such a way that each arm 12 remains fitted between the square plates and the side walls 1 of the supporting device thus remaining suspended by the coupling of the side edges of said plates 4 into the respective horizontal ribs 12*a* provided in the arms 12 (see FIGS. 3 and 4).

Despite the fact that a preferred embodiment has been described and illustrated, it should be noticed that structural changes can be made and attained without departing from the scope of the present improvement.

What is claimed is:

1. A device for supporting tamping bench arms and for engagement with a horizontal rib provided on said arms, comprising:

a pair of parallel rectangular spaced apart side walls (1) each having an upper edge, a rectangular back wall (2) interconnecting said side walls (1) having an upper edge, a lower edge and a central surface portion, coupling means (3) provided on said upper edge of said side walls (1) for coupling said device to a suspension means for suspension of said device, and a pair of horizontal rectangular plates (4) fixed to the central surface portion of the upper and lower edges of said rectangular back wall (2), said horizontal rectangular plates (4) extending up to approximately half the length of said side walls (1) and being adapted for sliding, supportive engagement with the horizontal rib (12*a*) provided in the tamping bench arms (12).

2. A device according to claim 1, wherein said coupling means are "O" rings and said suspensions means is a suspension hook (11) adapted to be received therein.

* * * * *